US011499721B2

(12) United States Patent
Alt et al.

(10) Patent No.: US 11,499,721 B2
(45) Date of Patent: Nov. 15, 2022

(54) COOKING APPLIANCE HAVING A CABLE PULL DEVICE FOR AUTOMATICALLY PIVOTING A DOOR

(71) Applicant: BSH Hausgeräte GmbH, Munich (DE)

(72) Inventors: René Alt, Otterfing (DE); Ralf Grobleben, Bretten (DE); Torsten Popp, Pfaffenhofen (DE); Thomas Rembold, Lehrensteinfeld (DE); Tobias Schmidt, Munich (DE)

(73) Assignee: BSH Hausgeräte GmbH, Munich (DE)

( * ) Notice: Subject to any disclaimer, the term of this patent is extended or adjusted under 35 U.S.C. 154(b) by 215 days.

(21) Appl. No.: 16/500,414

(22) PCT Filed: Apr. 17, 2018

(86) PCT No.: PCT/EP2018/059717

§ 371 (c)(1),
(2) Date: Oct. 3, 2019

(87) PCT Pub. No.: WO2018/206241

PCT Pub. Date: Nov. 15, 2018

(65) Prior Publication Data

US 2021/0116133 A1 Apr. 22, 2021

(30) Foreign Application Priority Data

May 11, 2017 (DE) ..... 10 2017 207 980.0

(51) Int. Cl.
*F24C 15/02* (2006.01)

(52) U.S. Cl.
CPC ..... *F24C 15/028* (2013.01)

(58) Field of Classification Search
CPC ..... F24C 15/028
See application file for complete search history.

(56) References Cited

U.S. PATENT DOCUMENTS

| | | | |
|---|---|---|---|
| 1,379,091 | A | 5/1921 | Farquhar |
| 7,064,296 | B1 | 6/2006 | Harned et al. |
| 10,408,465 | B2 | 10/2019 | Grobleben et al. |
| 2004/0144380 | A1 | 7/2004 | Grutzke et al. |

(Continued)

FOREIGN PATENT DOCUMENTS

| | | | |
|---|---|---|---|
| DE | 19906913 | A1 | 8/2000 |
| DE | 102011078535 | A1 | 1/2013 |

(Continued)

OTHER PUBLICATIONS

National Search Report DE 10 2017 207 980.0 dated Mar. 7, 2018.
International Search Report dated Jul. 9, 2018.

*Primary Examiner* — Jason Lau
(74) *Attorney, Agent, or Firm* — Michael E. Tschupp; Andre Pallapies; Brandon G. Braun

(57) ABSTRACT

A cooking appliance includes a housing having a cooking chamber, and a door configured to close the cooking chamber. The door is arranged on the housing in a pivotable manner and capable of being lowered into a storage space in the housing. A drive unit automatically implements a movement of the door along a movement path. The drive unit includes a motor and a cable pull device, which is coupled to the motor and the door such that the movement of the door is implemented as a function of a motorized actuation of the cable pull device.

2 Claims, 3 Drawing Sheets

(56) References Cited

U.S. PATENT DOCUMENTS

| | | | | |
|---|---|---|---|---|
| 2006/0245883 | A1* | 11/2006 | Fontaine | B60P 1/431<br>414/537 |
| 2009/0013986 | A1* | 1/2009 | Meyer | E05D 15/58<br>126/194 |
| 2011/0017191 | A1* | 1/2011 | White | E05D 11/087<br>126/198 |

FOREIGN PATENT DOCUMENTS

| | | | |
|---|---|---|---|
| DE | 102011086970 | A1 | 5/2013 |
| EP | 1039231 | A2 | 9/2000 |
| EP | 2189725 | A2 | 5/2010 |
| EP | 2574712 | A1 | 4/2013 |

* cited by examiner

COOKING APPLIANCE HAVING A CABLE PULL DEVICE FOR AUTOMATICALLY PIVOTING A DOOR

CROSS-REFERENCES TO RELATED APPLICATIONS

This application is the U.S. National Stage of International Application No. PCT/EP2018/059717, filed Apr. 17, 2018, which designated the United States and has been published as International Publication No. WO 2018/206241 A1 and which claims the priority of German Patent Application, Ser. No. 10 2017 207 980.0, filed May 11, 2017, pursuant to 35 U.S.C. 119(a)-(d).

BACKGROUND OF THE INVENTION

The invention relates to a cooking appliance with a housing, in which a cooking chamber is configured. The cooking appliance has a door, which is configured to close the cooking chamber. The door is arranged on the housing in a pivotable manner. The cooking appliance also has a storage space, which is configured in the housing. The door can be lowered into said storage space. The cooking appliance also has a drive unit with a motor, by means of which the movement of the door can be brought about automatically.

A household appliance device with at least one door unit is known from DE 10 2008 010 526 A1. The door unit is fastened to a housing of the household appliance with hinges and can be pivoted relative thereto and can be lowered in a storage space configured below the receiving chamber in the opened state. The hinges also comprise a hinge part in the form of a U-shaped bracket, on which two rollers are supported in a rotatable manner. The bracket per se is rigid and can be pivoted about a rotation axis.

The equivalent is also known from EP 2 574 712 A1, the design of the hinge also comprising a hinge housing and a storage unit in the form of a U-shaped bracket, which is a hinge hook, arranged rotatably thereon.

A door for a kitchen appliance is also known from DE 199 06 913 A1. The door can be moved automatically by means of a motorized drive unit and can also be lowered in a storage space configured in the housing of the kitchen appliance.

The design there has main channels, in which spindle-type, pliable cables with a sliding block run, to which the oven door is fastened with a drive pin in such a manner that it can be moved rotatably. Such designs are however error-prone and disadvantageous in respect of spreading or jamming.

BRIEF SUMMARY OF THE INVENTION

It is the object of the present invention to create a cooking appliance, in which the movement of a door by means of a drive unit is improved in respect of reliable and non-jamming or smooth movement.

This object is achieved by a cooking appliance with the features set out in claim 1.

One aspect of the invention relates to a cooking appliance with a housing, in which a cooking chamber is configured. The cooking appliance also has a door for closing the cooking chamber. The door is arranged on the housing in a pivotable manner. The cooking appliance also has a storage space, which is configured in the housing. The door can be lowered in said storage space. The cooking appliance also has a drive unit with a motor, it being possible for the movement of the door to be brought about automatically by means of the drive unit. The drive unit has a cable pull device, which is coupled to the motor and the door. The movement of the door can be brought about as a function of a motorized actuation of the cable pull device. Such a design provides a simple and robust system that functions well mechanically and improves the automatic actuation of the door. In particular it allows non-jamming and smooth movement of the door, both when the door is opened and therefore moves into the storage space and when the door is closed and therefore moves out of the storage space.

In one advantageous embodiment the movement path of the door, which is brought about automatically by means of the drive unit, is only part of the complete movement path between a closed position of the door and a fully opened door. This means that a further part of the complete movement path of the door is not brought about by way of said drive unit but by a different further device of the cooking appliance and/or manually by a user, by gripping the door directly and moving it by a corresponding force input. Such a design prevents unwanted automatic door movements, in particular possibly uncontrolled arrival in an end position.

Provision is preferably made for said above-mentioned partial path, which is brought about automatically by means of the drive unit, to start from an angular position of the door with an angle between 15° and 25° to the closed position. This means that from a closed position of the door the partial path between the closed position and said cited angular position is not brought about by the drive unit. Only the partial path from said angular position when reached to larger angular positions, in particular up to the fully opened position and when moved completely into the storage space, can be brought about by said drive unit. This specific configuration of the partial path in particular further enhances the advantages cited above.

Provision is preferably made for a movement path of the door, which is not brought about by the drive unit, to extend between the closed position of the door and the start of the partial path.

Provision is made in particular for the door to have hinges, which have at least one spring element. The spring element is in particular arranged in such a manner that the movement path of the door between the partial path and the closed position of the door is brought about by the spring force of the spring element. This design therefore represents a more specific instance of the alternative cited above, in which a device of the cooking appliance is present, which brings about the movement of the door that is not brought about by the drive unit with the motor. With such a design therefore there is an interaction between two different devices, specifically the drive unit with the motor and the cited device with the spring element, which in one advantageous embodiment then bring about the complete movement path of the door, with different partial paths being brought about on the one hand by the drive unit and on the other hand by the cited device with the spring element. This interaction of different functional concepts to actuate the movement of the door results in a particularly tailored behavior of the movement of the door, in particular allowing completion of a very smooth and spread-free movement.

Provision is preferably made for the door to have at least one damping module, which damps the movement of the door along the movement path, which is not brought about by the drive unit. This prevents undesirably uncontrolled arrival in an end position for the door. For it is possible to prevent an undesirable uncontrolled arrival in the end position precisely when the movement is brought about by means of an additional device, in particular with a spring element, and an end position is reached on said movement path of the door, which is brought about by said device with the spring element.

Said damping module is in particular coupled to a hinge of the door, in particular being directly flanged thereto. This renders the operating principle particularly efficient and allows a very compact arrangement of the cited components.

Provision is preferably made for the cable pull device to be coupled to a carriage, which is coupled to the door. The carriage here is part of the cooking appliance. Such a design provides a mechanically stable connection to a component, specifically the carriage, which can in turn transmit corresponding forces to the door. Said carriage here is configured in a correspondingly robust manner and can absorb corresponding forces but is also sturdy enough to prevent undesirable deformation.

Provision is preferably made for the carriage to have a brake unit, which is connected to the door. The brake unit damps the coupling of the door to the carriage when the door is in the coupling position. This prevents undesirably uncontrolled coupling or striking of the door during coupling with the carriage. In an advantageous embodiment the carriage is not coupled to the door over the complete movement path of the door between a closed position and an opened position. It is then particularly advantageous with such embodiments to establish the brake unit in order to prevent uncontrolled striking during coupling.

Provision is preferably made for the brake unit to be a hydraulic brake unit. This allows very effective brake functionality while taking up little space.

Provision is preferably made for the carriage to be guided in a guide facility of the cooking appliance. This advantageously assists precise guidance of carriage movement.

Provision is preferably made for the guide facility to be arranged on a base of the storage space. Provision can also be made additionally or instead for the guide facility to be arranged so that it runs in a straight line in the depthwise direction of the cooking appliance. This also results in a space-saving configuration allowing simple and continuous movement of the carriage.

In one advantageous embodiment provision is made for the door to have hinges, which are guided in guide channels when the door is moved into the storage space or out of the storage space. The guide channels are separate and at a distance from the guide facilities of the carriage.

As an alternative to the damping module and/or brake unit, which are cited as advantageous embodiments, electronically controlled slow braking of the carriage can be configured, in particular when the door is closed. This can be achieved for example by way of an additional facility of the cited drive unit.

The terms "top", "bottom", "front", "rear", "horizontal", "vertical", "depthwise direction", "widthwise direction", "heightwise direction", etc. refer to the positions and orientations resulting when the appliance is used and arranged in the correct manner.

Further features of the invention will emerge from the claims, figures and description of the figures. The features and feature combinations cited above in the description as well as the features and feature combinations cited in the following in the description of the figures and/or shown in the figures alone can be used not only in the respectively cited combination but also in other combinations or alone, without departing from the scope of the invention. Therefore embodiments of the invention which are not specifically described and illustrated in the figures but will emerge and can be generated from the described embodiments as a result of separate feature combinations are also deemed to be covered and disclosed by the invention. Embodiments and feature combinations which do not therefore have all the features of an originally formulated independent claim should also be deemed to be disclosed.

BRIEF DESCRIPTION OF THE DRAWINGS

Exemplary embodiments of the invention are described in more detail below with reference to schematic drawings, in which.

DETAILED DESCRIPTION OF EXEMPLARY EMBODIMENTS OF THE PRESENT INVENTION

Figure 1:
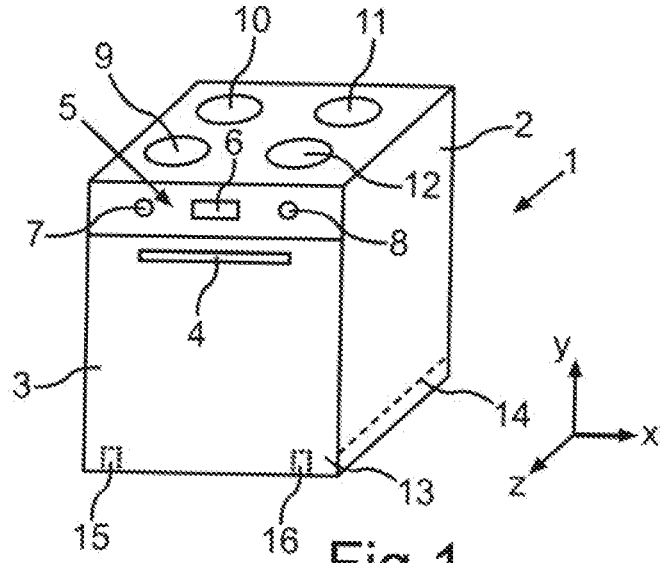
FIG. 1 shows a perspective view of an exemplary embodiment of an inventive cooking appliance.

Identical elements or those of identical function are shown with the same reference characters in the figures.

FIG. 1 shows a schematic perspective view of a cooking appliance 1 configured as an oven. The cooking appliance 1 has a housing 2, in which a cooking chamber delimited by a muffle (not shown) is configured. Food to be prepared can be placed in the cooking chamber. The front of the cooking chamber can be closed by a door 3, which is shown in the closed end position in FIG. 1. A handle 4 by way of example is configured on the front face of the door 3.

The cooking appliance 1 also has an operating device 5, which has a display unit 6 and operating elements 7 and 8, the position and configuration of which are simply by way of example.

Cooking zones 9, 10, 11 and 12, the position and number of which are also simply by way of example, are also shown. The cooking zones 9 to 12 can also not be present.

The lower region 13 of the door 3 can be pushed or lowered into the housing 2, as is the case when the door 3 is moved from the closed end position shown in FIG. 1 to the fully open end position. The door 3 is then arranged in a lowered manner in a free space in the housing 2, said free space forming a storage space 14 arranged below the cooking chamber and separated therefrom by a corresponding separating wall.

The door 3 is connected to movement units 15 and 16 shown and marked by way of example and can be pivoted and moved into and out of the cited storage space 14 by means of these.

Figure 2:
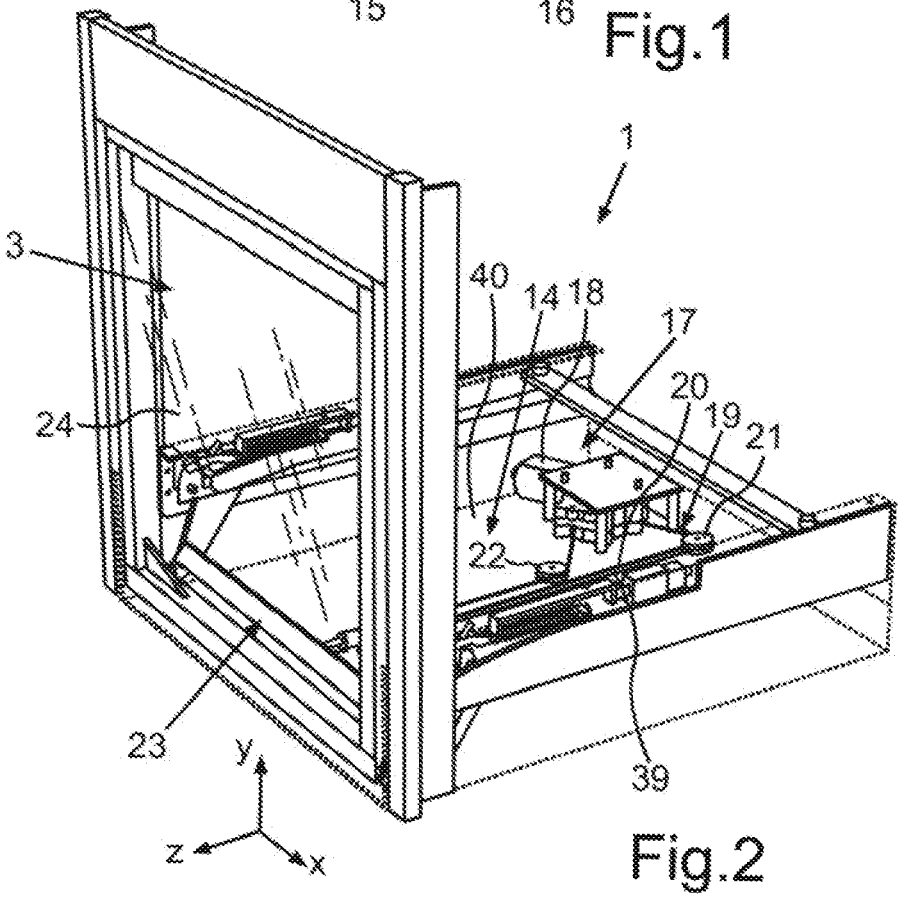
FIG. 2 shows a perspective view of subcomponents of the cooking appliance according to FIG. 1 with a door in the fully closed position.

FIG. 2 shows subcomponents of the cooking appliance 1. It shows a view into the storage space 14 in order to show the components for said automatic movement of the door 3. The door 3 here is shown in the fully closed position as in FIG. 1. The cooking appliance 1 has a drive unit 17. Said drive unit 17 has a motor 18. An automatic movement of the door 3 can be brought about by means of the drive unit 17. The drive unit 17 has a cable pull device 19 with a cable 20. Said cable pull device 19 is coupled to the motor 18 and the door 3. A movement of the door 3 can be brought about as a function of a motorized actuation of the cable pull device 19 with the motor 18.

As shown in FIG. 2, the cable 20 in the exemplary embodiment here is deflected by way of a number of deflection points 21 and 22 to achieve particularly effective movement of the cable 20 and to configure the space in a compact manner.

It can also be seen in FIG. 2 that the door has a carrier 23, which supports a door leaf 24 of the door 3.

Figure 5:
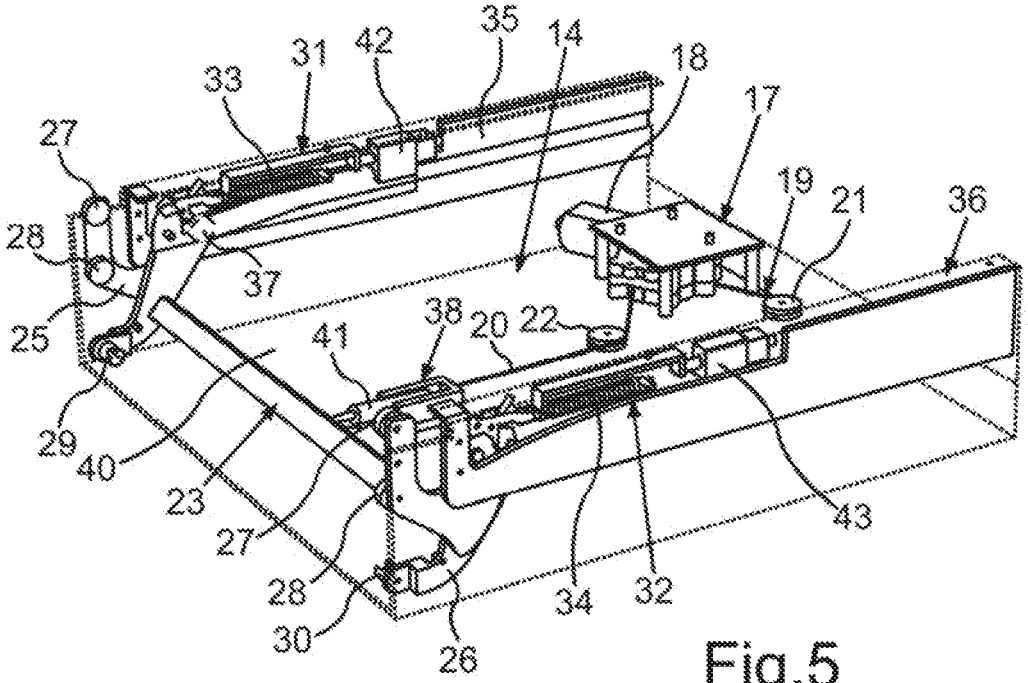
FIG. 5 shows a view from FIG. 2 with some subcomponents from FIG. 2.

The view in FIG. 5 shows the design according to FIG. 2 without the door leaf 24 so that it is possible to see all round the carrier 23.

The carrier 23 has bearing parts 25 and 26, which are shown in FIG. 5. These bearing parts 25 and 26 are configured as U-shaped in particular. Two rollers 27 and 28 in particular are configured respectively thereon. A coupling to the door leaf 24 is provided by way of said rollers 27 and 28, with corresponding guide channels being arranged on vertical side edges of the door leaf 24, in which said rollers 27 and 28 engage and roll along accordingly.

The door leaf 24 is also connected to coupling pegs 29 and 30, which are configured on brackets of the carrier 23.

The bearing parts 25 and 26 are also connected respectively to a hinge 31 and 32. The hinges 31 and 32 in particular have a spring element 33 and 34 respectively. The carrier 23 runs along guide channels 35 and 36. The bearing parts 25 and 26 also engage in said guide channels 35 and 36, in particular by way of further rollers, only the roller 37 of the bearing part 25 being shown in FIG. 5.

As also shown in FIG. 2 and FIG. 5, the cable pull device 19 is advantageously coupled to a carriage 38 that is present in particular. The carriage 38 is guided in a guide facility 39. The guide facility 39 is arranged on a base 40, which delimits the bottom of the storage space 14. The guide facility 39 is configured to guide the carriage 38 in a straight line, in particular in the depthwise direction (z direction) of the cooking appliance 1.

The carriage 38 has a separate brake unit 41. The brake unit 41 is connected to the carrier 23 of the door 3, when the carriage 38 is coupled to the door 3. The brake unit 41, which can be in particular a hydraulic brake unit, damps said coupling between the carrier 23 and the brake unit 38.

As shown in FIG. 5, the cooking appliance 1 is also configured with at least one separate damping module 42, in particular with two damping modules 42 and 43, which are coupled to the hinges 31 and 32, in particular being directly flanged thereto.

Figure 3:
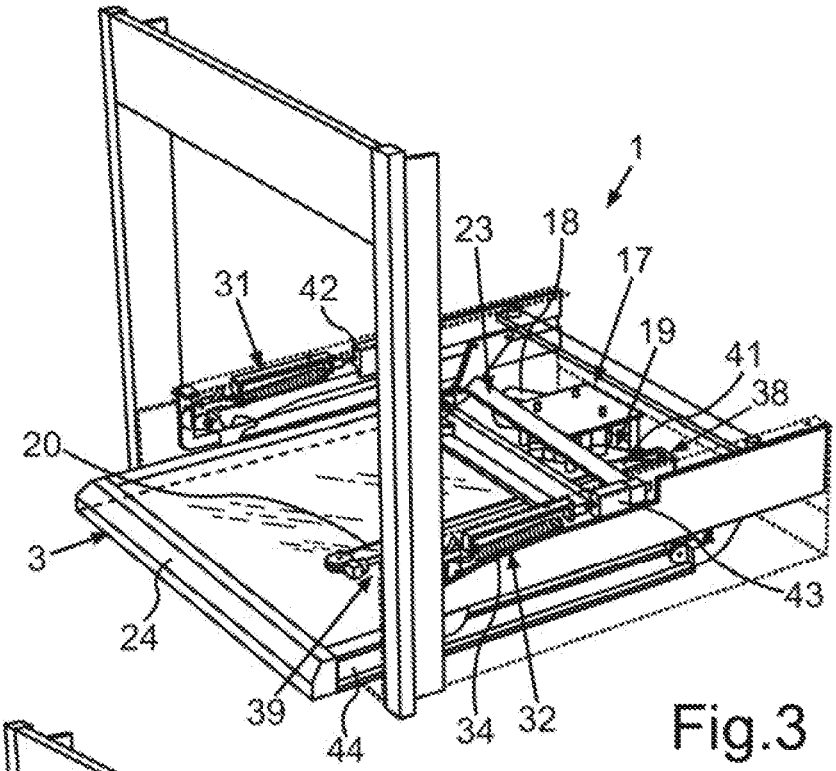
FIG. 3 shows the view of the components according to FIG. 2 with the door in a fully opened position.

FIG. 3 shows the component arrangement according to FIG. 2, but with the door 3 in the fully opened state in contrast to the view in FIG. 2 and therefore in an opened end position, in which the door 3 is lowered into the storage space 14. FIG. 3 also shows the peripheral guide tracks or guide channels at least on one side of the door leaf 24. A corresponding guide channel 44 is provided to hold the rollers 27 and 28.

Figure 6:
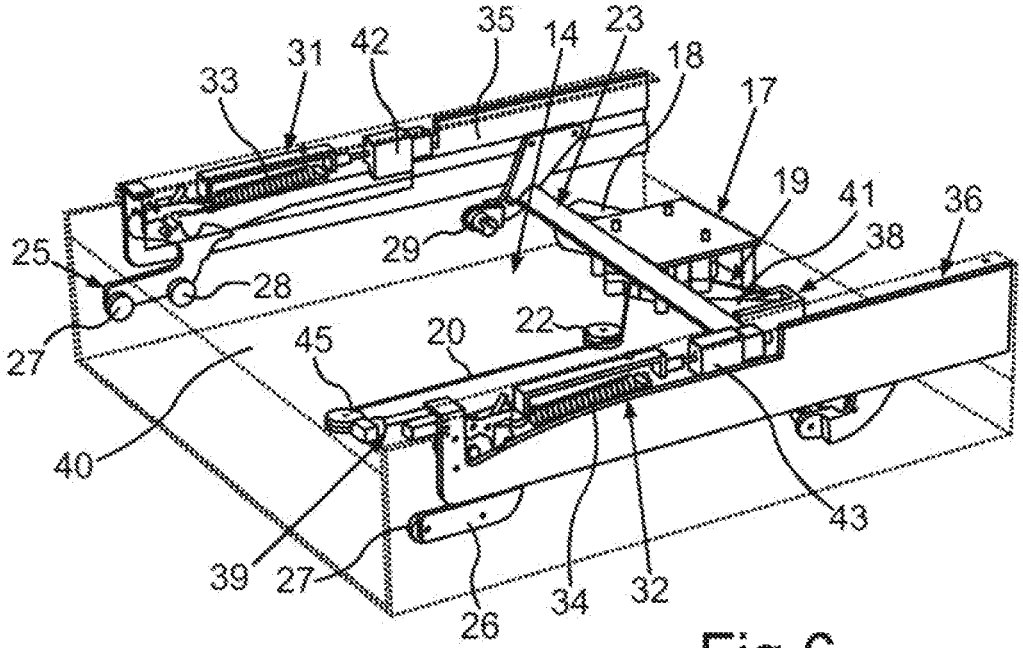
FIG. 6 shows a view from FIG. 3 with some subcomponents from FIG. 3.

FIG. 6 also shows a reduced component arrangement, in which the door leaf 24 and the enclosing flange or frame are not shown. FIG. 6 shows a further deflection point 45, in particular a deflection roller, which is not shown or cannot be seen in FIG. 5.

Figure 4:
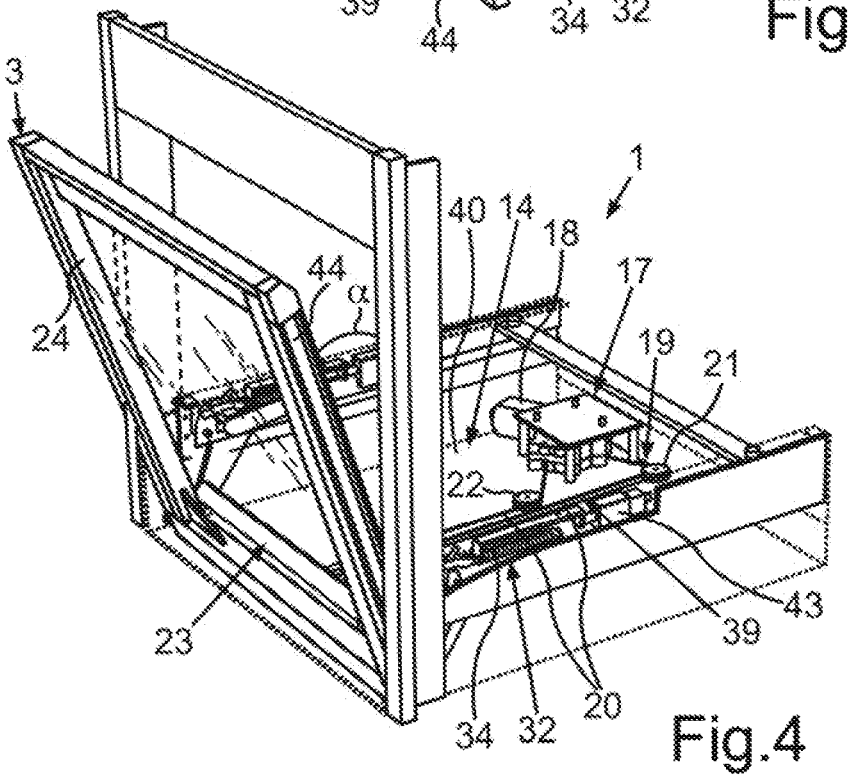
FIG. 4 shows a view of the components according to FIG. 2 and FIG. 3 of a door in a position, in which the further movement path of the door into the opened position is brought about by a drive unit with a motor.

FIG. 4 shows the component arrangement according to FIG. 2 and FIG. 3. However in FIG. 4 the door 3 and therefore also the door leaf 24 are shown in an intermediate position between the fully closed position and the fully opened position. In this intermediate position the door leaf 24 is at an angle $\alpha$ between 15° and 25°, in particular between 17° and 19°, to the vertical position and therefore to the fully closed position according to FIG. 2.

Provision is made in particular for the automatic movement of the door 3 by the drive unit 17 only to take place over a partial path from said intermediate position, as shown in FIG. 4, to the fully opened position according to FIG. 3, or in the reverse direction during the closing movement from the fully opened position in FIG. 3 to said intermediate position in FIG. 4.

In one embodiment of the invention provision is made for the movement of the door 3 from said intermediate position to the closed position, as shown in FIG. 2, or from said fully closed position according to FIG. 2 to said intermediate position according to FIG. 4 not to take place by way of the drive unit 17. Provision can be made for said movement over the further partial path, which is not brought about automatically by way of said drive unit 17, to take place by way of a different device. This device can be configured with the spring elements 33 and 34 and can bring about said movement.

The damping modules 42 and 43 damp the movement of the door 3 from the intermediate position according to FIG. 4 to the fully closed position according to FIG. 2. Provision is then also advantageously made for damping from the fully closed position according to FIG. 2 to the intermediate position according to FIG. 4.

As the cable pull device 19 is coupled to the carriage 38 and the movement of the cable 20 is brought about by the motor 18, the movement of the carriage 38 forward and backward is also brought about by the motor 18, in that the cable 20 initiates the same movement correspondingly for the carriage 38.

In order preferably to achieve gentle closing of the door 3 here too, the carriage 38 is set so that it does not push the door 3 to its closed end position, as shown in FIG. 2, but only to said intermediate position according to FIG. 4. The remainder of the then also preferably gentle closing movement, which takes place by way of the damping module 42 or the damping module 43, is brought about by the spring force of the spring elements 33 and 34.

As the door 3 opens, the force of its weight exceeds the spring force of the spring elements 33 and 34 beyond a certain opening angle, in particular beyond the opening angle according to the intermediate position in FIG. 4. The brake unit 41 is then preferably present to prevent unwanted dynamic escalation of vibration due to said further movement from the intermediate position according to FIG. 4 to the opened position according to FIG. 3.

Provision is preferably made for a coupling between the carrier 23 and the carriage 38 by way of the brake unit 41 that is preferably present only to be brought about in the intermediate position according to FIG. 4 and for there to be no coupling to the carriage 23 on the movement path between said intermediate position and the closed position of the door 3.

The invention claimed is:

1. A cooking appliance, comprising:

a housing having a cooking chamber;

a door configured to close the cooking chamber, said door being arranged on the housing in a pivotable manner and capable of being lowered into a storage space in the housing;

a drive unit configured to automatically implement a movement of the door along a movement path, said drive unit including a motor and a cable pull device, said cable pull device being coupled to the motor and the door such that the movement of the door is implemented as a function of a motorized actuation of the cable pull device; and a damping module configured to damp the movement of the door along the movement path, which is not implemented by the drive unit, wherein the movement path of the door represents only a partial movement path of a complete movement path between a closed position of the door and a fully opened position of the door, a remaining movement path of the door, which is not implemented by the drive unit, extends between the closed position of the door and a start of the partial movement path, the door includes a hinge, said damping module being coupled to the hinge of the door, and the damping module is directly flanged to the hinge.

2. A cooking appliance, comprising:

a housing having a cooking chamber;

a door configured to close the cooking chamber, said door being arranged on the housing in a pivotable manner and capable of being lowered into a storage space in the housing;

a drive unit configured to automatically implement a movement of the door along a movement path, said drive unit including a motor and a cable pull device, said cable pull device being coupled to the motor and the door such that the movement of the door is implemented as a function of a motorized actuation of the cable pull device; and a carriage coupled to the door, said cable pull device being coupled to the carriage, wherein the carriage includes a brake unit, which is connected to the door to damp a coupling of the door to the carriage, when the door is in a coupling position, and the brake unit is a hydraulic brake unit.

* * * * *